US008794857B2

(12) United States Patent
Handrinos

(10) Patent No.: US 8,794,857 B2
(45) Date of Patent: Aug. 5, 2014

(54) NON-CONSUMABLE WRITING IMPLEMENT WITH CONSUMABLE TIP HAVING CONSTANT ORIENTATION

(76) Inventor: Dean Handrinos, New York, NY (US)

( * ) Notice: Subject to any disclaimer, the term of this patent is extended or adjusted under 35 U.S.C. 154(b) by 525 days.

(21) Appl. No.: 13/225,818

(22) Filed: Sep. 6, 2011

(65) Prior Publication Data

US 2013/0058702 A1 Mar. 7, 2013

(51) Int. Cl.
*B43K 21/22* (2006.01)
*B43K 21/00* (2006.01)
*B43K 29/02* (2006.01)

(52) U.S. Cl.
CPC ..... *B43K 21/00* (2013.01); *B43K 21/22* (2013.01); *B43K 21/006* (2013.01); *B43K 29/02* (2013.01)
USPC ..... 401/92; 401/52; 401/115

(58) Field of Classification Search
USPC ..... 401/52, 92–94, 100, 115, 195
See application file for complete search history.

(56) References Cited

U.S. PATENT DOCUMENTS 1,864,038 A 6/1932 Barberon
2,849,738 A * 9/1958 Hopkins ..... 401/100
4,299,506 A 11/1981 Hashimoto
4,377,349 A * 3/1983 Kunii ..... 401/115
4,411,543 A 10/1983 Hashimoto et al.
6,702,495 B1 3/2004 Lychwick
7,721,378 B2 5/2010 Ostrobrod
7,802,936 B1 9/2010 Izawa et al.
7,815,385 B2 10/2010 Izawa et al.

* cited by examiner

*Primary Examiner* — David Walczak

(74) *Attorney, Agent, or Firm* — Michael J. Feigin, Esq.; Feigin & Associates, LLC

(57) ABSTRACT

A non-consumable writing implement, such as a mechanical pencil, with a consumable tip has a body with an outer housing. (See definitions in the "Summary" section). An inner retainer with a gripping mechanism is adapted to grip a consumable product held therein. That is, in one embodiment, a piece of graphite is gripped inside a mechanical pencil. The inner retainer, held within the outer housing, and a ballast attached to the inner retainer, are rotatable with respect to the outer housing. The ballast rotates the gripping mechanism and the consumable product. In this manner, a user desiring to have the tip of the consumable product always in the same orientation as he writes, may use this device to do so. A damper and detent mechanism may be employed to prevent harmonic movement or turning of the consumable product during writing.

19 Claims, 7 Drawing Sheets

NON-CONSUMABLE WRITING IMPLEMENT WITH CONSUMABLE TIP HAVING CONSTANT ORIENTATION

FIELD OF THE DISCLOSED TECHNOLOGY

The disclosed technology relates generally to writing implements and more particularly towards the orientation of the writing end while in use.

BACKGROUND OF THE DISCLOSED TECHNOLOGY

Consumable writing implements include pens, pencils, markers, crayons, chalk, and highlighters which rub or leave a portion of the contents on the item to be written on. Some of these devices are themselves consumable. For example, a crayon is consumable in its entirety. Likewise, a pencil is consumable in its entirety. For purposes of this disclosure, "consumable" is defined as the non-discarded or typically thrown away portion being used for writing or making markings on a target where it is used. A "non-consumable writing implement" is a writing implement designed for multiple-time use and which houses a consumable portion therein. For example, a mechanical pencil is a non-consumable product, with consumable graphite therein, and is designed for use with multiple pieces of a consumable product. An entirely consumable writing implement, such as a wooden pencil, might also have parts which are generally disposed of after the consumable product is used up or no longer fit for use in writing.

Modifications to the writing implements which take place while writing or preparing to write are known in the art. Pencils and crayons may be sharpened, and rubbing may take place on one side more than the other. Others, such as U.S. Pat. No. 7,802,936, disclose rotating the consumable end portion of graphite held within a mechanical pencil a little bit each time a user presses down. U.S. Pat. No. 4,411,543 discloses advancing the graphite each time a user presses down.

However, other advancements and improvements are desired by some users who prefer to write in a particular manner, which users of non-consumable writing implements currently must do without. These advancements will be described in the summary of the disclosed technology.

SUMMARY OF THE DISCLOSED TECHNOLOGY

An object of the disclosed technology is to allow the consumable portion of a non-consumable writing instrument always to be in the same orientation at the writing tip.

Another object of the disclosed technology is to allow a user to pick up a writing instrument, and, regardless of orientation around a horizontal axis of the instrument, allow the user to continue writing as if the instrument had never been put down.

In an embodiment of the disclosed technology, a non-consumable writing implement with a consumable tip has a body with an outer housing, an inner retainer with gripping mechanism adapted to grip a consumable product held therein, the inner retainer held within the outer housing, and a ballast attached to the inner retainer and rotatable with respect to the outer housing. The ballast rotates the gripping mechanism and the consumable product.

The implement above may further have a toothed detent mechanism or friction mechanism which prevents rotation of the ballast when the outer housing is bent, such as when writing with the implement. The ballast may have a greater density than the inner retainer to which it is attached (or a part thereof) and may extend along the majority of a length of the inner retainer, such as longitudinally between a tip portion of the writing implement and an end portion opposite the tip portion, the tip adapted for writing. The ballast may then be parallel to the inner retainer and may be fixed to an outside portion thereof, and may form a unitary structure with the rest of the inner retainer, the ballast portion being denser (and in some cases, heavier) than the rest of the inner retainer, and being on one half, or less than one half, of a side of the inner retainer. A rotational damper may be engaged with the inner housing.

In another embodiment of the disclosed technology, a holder adapted to frictionally hold a graphite rod within a rotatable chamber is claimed, the rotating chamber connected to a support bearing, or multiple support bearings. A weight is fixedly attached to the rotatable chamber, and an outer housing connects to the support bearing(s). As such, a hollow space is formed between the rotatable chamber and the outer housing, this space being adapted for 360 degrees of rotation of the weight within the hollow space. A change in angle of the device with respect to the direction of gravity causes the weight and said rotatable chamber to rotate. This rotation may be impeded by a rotational damper frictionally engaged with the inner chamber to prevent harmonic motion (oscillations). Teeth, fixedly attached to the rotatable chamber, and corresponding teeth which are fixedly attached to the outer housing, may prevent rotation of the rotatable chamber when the outer housing is bent, which may happen when pressure is applied during writing. Such pressure, in an embodiment of the disclosed technology, is enough to cause bending which prevents rotating.

A cylindrical writing instrument may also have an inner, cylindrical chamber housing graphite and having a heavy and a light side. A rotatable connection between the inner, cylindrical chamber and at least two spaced apart support bearings may allow rotating of the inner chamber with respect to the support bearings. Inside the inner, cylindrical chamber, there is a clamp fixedly attached thereto, and adapted to grasp the graphite. The heavy side of the inner, cylindrical chamber rotates towards a gravitational bottom, causing graphite therein to be rotated accordingly.

This writing instrument may further have an outer housing with a fixed orientation to the support bearings. When writing at a first angle, the graphite has an identical rotational orientation towards a writing surface, regardless of a rotational orientation of the support bearings and the outer housing, in embodiments.

The heavy side (of the inner chamber) may have a weight fixedly attached thereto, making this side heavier than the other. This weight may be semi-cylindrical and run at least a part of a length of the cylindrical, inner housing.

A conic tip may be fixed to the outer housing or, alternatively, rotate with the graphite. A locking mechanism, preventing rotating of the inner, cylindrical housing when pressure is applied to a tip of graphite, may also be employed.

DETAILED DESCRIPTION OF EMBODIMENTS OF THE DISCLOSED TECHNOLOGY

In an embodiment of the disclosed technology, a non-consumable writing implement, such as a mechanical pencil, with a consumable tip has a body with an outer housing. (See definitions in the "Summary" section). An inner retainer with a gripping mechanism is adapted to grip a consumable product held therein. That is, in one embodiment, a piece of graphite is gripped inside a mechanical pencil. The inner retainer, held within the outer housing, and a ballast attached to the inner retainer, are rotatable with respect to the outer housing. The ballast rotates the gripping mechanism and the consumable product. In this manner, a user desiring to have the tip of the consumable product always in the same orientation as he writes, may use this device to do so. A damper and detent mechanism may be employed to prevent harmonic movement or turning of the consumable product during writing.

Figure 1:
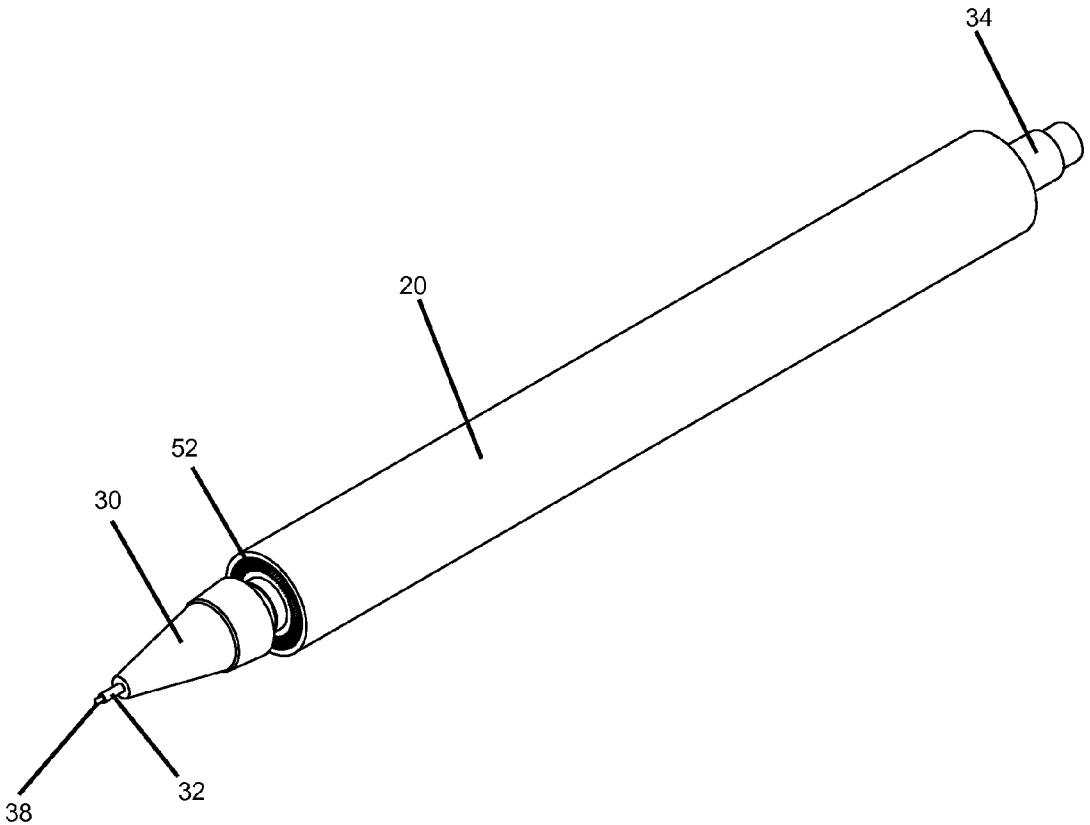
FIG. 1 shows an exterior, perspective view of a writing instrument of embodiments of the disclosed technology.

FIG. 1 shows an exterior, perspective view of a writing instrument of embodiments of the disclosed technology. The cylindrical outer casing 20 is permanent (meant to be reused) and holds a consumable product 38 therein in embodiments of the disclosed technology. At a front end of the outer casing a detent mechanism 52 is visible in this view. A back end 34 may have an eraser, pressable button, twistable button, or the like. Such a button may be used to advance the consumable product, such as graphite which extends out of the tip 32 on the conic piece 30, which comprises a grabbing mechanism, as known in the art, to grip the graphite or other consumable product. In embodiments of the disclosed technology, a mechanical pencil, from the outside, is indistinguishable from those known in the art and may be designed in any such manner. As such, those patents referenced in the Background section and Information Disclosure Statement of the U.S. Patent application are hereby incorporated by reference in their entirety, including U.S. Pat. Nos. 7,802,936 and 4,411,543.

Figure 2:
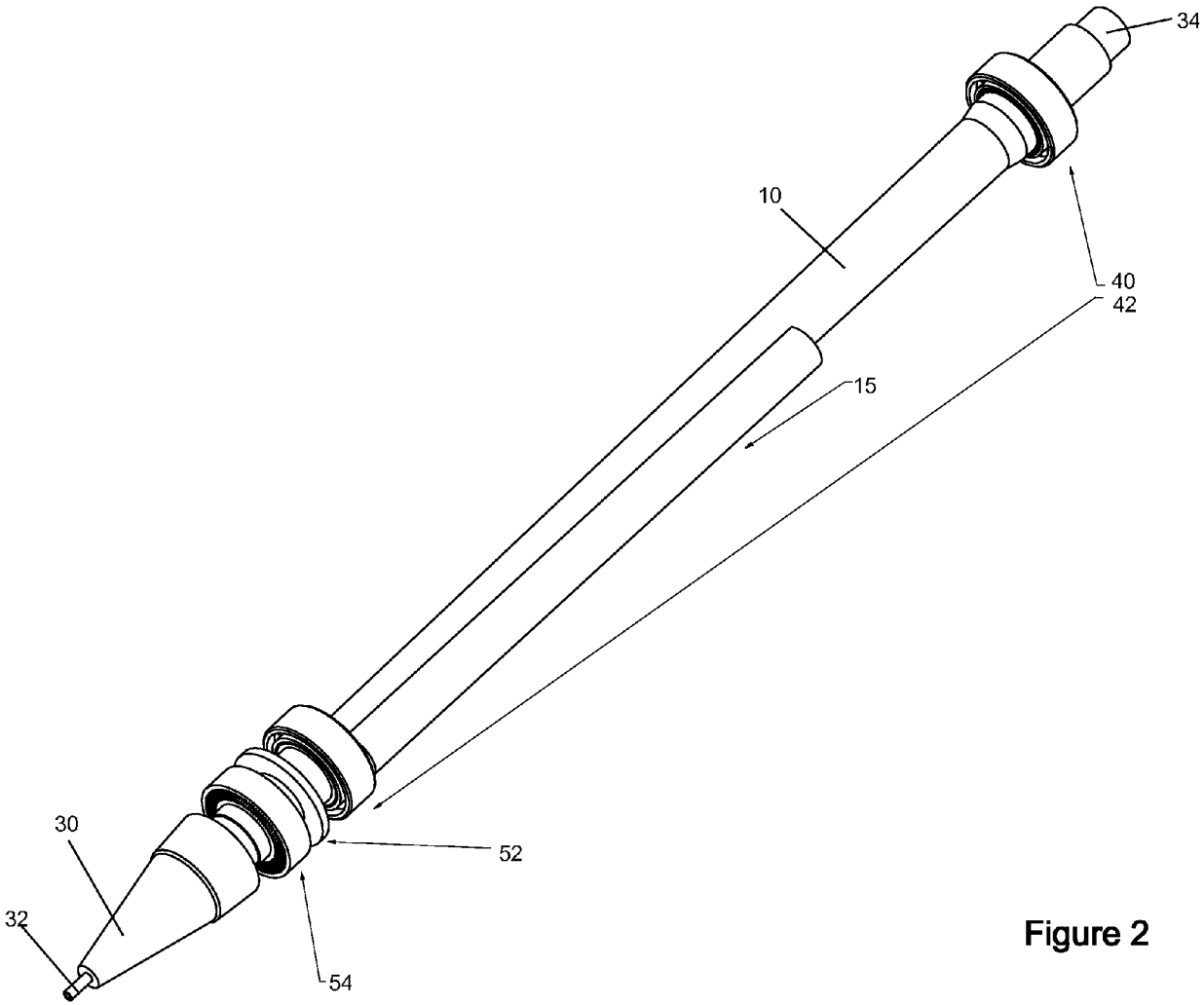
FIG. 2 shows the perspective view of the writing instrument of FIG. 1 with the outer housing removed.

FIG. 2 shows the perspective view of the writing instrument of FIG. 1 with the outer housing removed. The inner housing or rotatable housing 10 is rotatably connected to support bearings 40 (near the back end) and 42 (near the front end). A ballast or weight 15 extends along at least a part of the side of the inner housing 10. Consumable material (e.g., graphite) may be held within a hollow interior of the inner housing and may extend out from the tip 32 or be held for future expulsion through the tip 32 in due course, after being advanced by an advancement mechanism as referred to with reference to FIG. 1. The inner housing 10 may be cylindrical in shape, and the ballast 15 has a concave side to match the inner housing, and be fixedly attached thereto. A convex outer side of the ballast 15 may be adapted to fit within a hollow interior of the outer housing 10, such that the ballast 15 may rotate around a center point of the outer housing 10, freely. In other embodiments, the ballast 15 may simply be a heavier (denser) side of the inner housing and/or form a unitary structure with the inner housing 10. In some embodiments, the ballast bulges out from the cylindrical inner housing 10, and in others, it is uniform with the inner housing 10. The ballast may extend along the entire length of the elongated side of the inner housing 10, a majority of this length, half of this length, or less than half of this length. The density and/or weight of the ballast 15, in embodiments of the disclosed technology, is more than that of the inner housing 10.

Still referring to FIG. 2, a damper 52 prevents unwanted oscillations and harmonic motion. The damper 52 may be of a rotary dashpot type, which is a mechanical device that resists motion via viscous friction. The resulting force is proportional to the velocity, but acts in the opposite direction, slowing the motion and absorbing energy. It may be used in conjunction with a spring to resist displacement.

Figure 3:
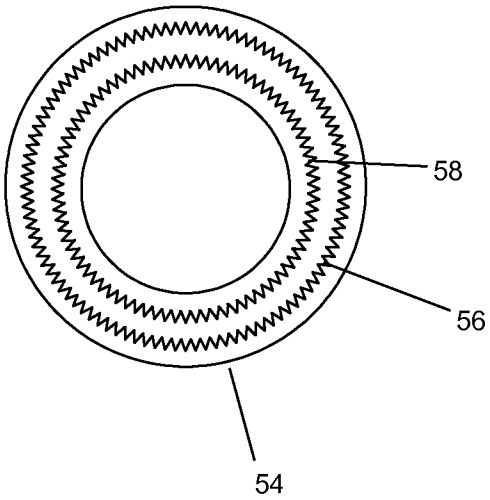
FIG. 3 shows a plan view of a toothed detent mechanism when the writing instrument of FIGS. 1 and 2 is unbent.

FIG. 3 shows a plan view of a toothed detent mechanism when the writing instrument of FIGS. 1 and 2 is unbent. "Detent", for purposes of this disclosure, is defined as a device with an outer and inner portion which frictionally, and in some cases, toothedly, engage with each other to prevent rotation of the ballast 15 with respect to the outer housing 10. The detent mechanism 54 (also viewable in FIG. 1) comprises an inner toothed portion 58 and outer toothed portion 56. The inner portion is fixedly connected to the inner housing 10, and the outer portion is fixedly connected to the outer housing 20. When the pencil or other non-consumable writing instrument is held straight or not in use, the teeth are spaced apart as shown in FIG. 3. The spacing may be on an order of magnitude of millimeters or centimeters, such as anywhere from 1 mm to 1 cm apart, or between 1 to 50 thousandths of an inch. As the inner housing 10 rotates, due to a change in orientation (which side of the elongated length of the device from tip 32 to back end 34 of the writing instrument faces towards the ground), the ballast spins the inner housing 10 with graphite or other consumable material inside.

Figure 4:
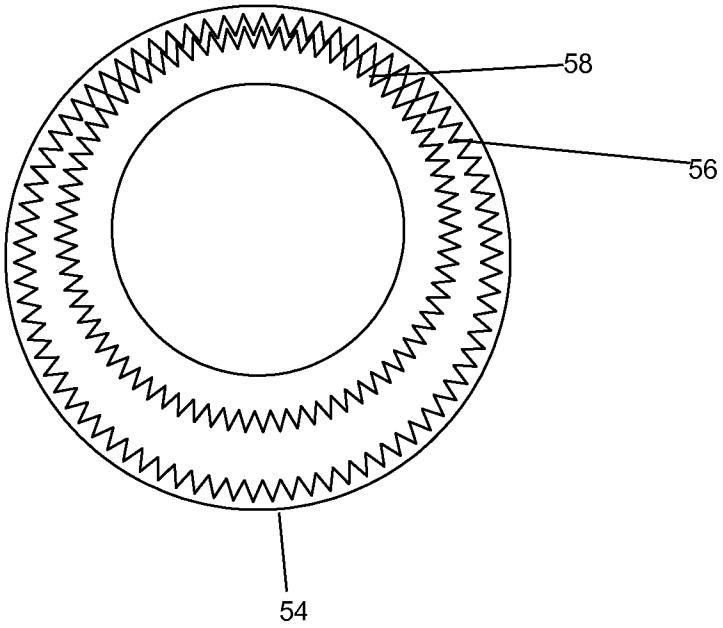
FIG. 4 shows a plan view of the toothed detent mechanism of FIG. 3 when the writing instrument of FIGS. 1 and 2 is bent.

FIG. 4 shows a plan view of the toothed detent mechanism of FIG. 3 when the writing instrument of FIGS. 1 and 2 is bent. When writing, enough minimal pressure is placed on the outer housing 20 to cause it to bend, and the teeth 56 and 58 become engaged with each other. In this manner, rotation of the ballast 15 and inner housing 10 with consumable product is prevented. This prevents rotation due to a user using the writing instrument, which places pressure on the consumable product which might otherwise turn while writing. In this manner, when using a detent mechanism, the consumable material (e.g., graphite) remains stationary, relative to the user's hand, while allowing it to turn to the previous orientation when the writing instrument is put down, and then picked up again, even when picked up in a different orientation. The ballast 15 is, of course, heavier than the consumable material (e.g., 150 grams compared to 10 grams, or a greater ratio there between), so that a weight change in the consumable material does not impede rotation. The type of detent mechanism used in an embodiment of the disclosed technology has many shallow teeth, such as at least 50 teeth which are no more than 1 mm to 1 cm deep.

Figure 5B:
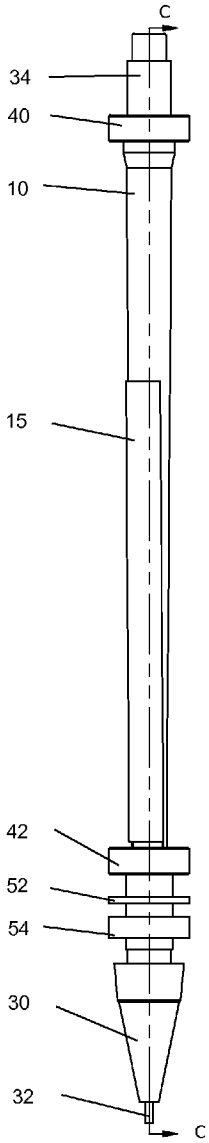
FIG. 5B shows a side perspective view of a writing utensil of an embodiment of the disclosed technology.
Figure 5A:
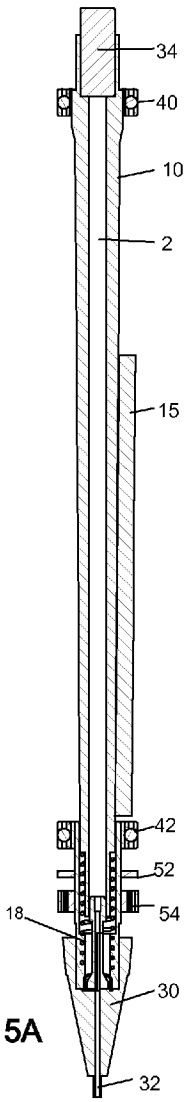
FIG. 5A shows a cutaway view of a writing utensil along section line C-C of FIG. 5B.

FIG. 5A shows a cutaway view of a writing utensil along section line C-C of FIG. 5B. FIG. 5B shows a side perspective view of a writing utensil of an embodiment of the disclosed technology. From top to bottom, the back end 34 houses an eraser and/or consumable product advancing button. Such elements within the back end 34 may be attached to the inner housing 10 (and thereby rotate with the consumable product extending out from tip 32) or the outer housing 20 (and thereby, remain stationary when the consumable product extending out from tip 32 rotates). Moving downwards from the back end 34, the support bearing 40 connects the inner housing 10 to the outer housing 20, such as by way of ball bearings allowing the inner housing to rotate within the support bearing 40, the support bearing 40 being fixedly attached or forming a unitary structure with the outer housing 20 (the outer housing is shown in prior figures). Within the elongated inner housing which extends from near/at the conic piece 30 to the back end 34 above or at the back support bearing 40, is a hollow tube 12 in embodiments of the disclosed technology. This hollow tube stores consumable pieces until use, or may hold the back ends of a consumable piece extending out from tip 32.

Continuing to move downward in FIG. 5A and FIG. 5B, the ballast 15 is attached to the inner housing 10 and adds weight on one side, or part of one side, of the inner tube. The ballast 15 may alternatively be integrated with the inner housing. The ballast, in embodiments, fits within the outer housing and a space between the inner and outer housing, so as to enable rotation around this space, and thereby, rotate the inner housing and especially a gripping mechanism 18 attached to the inner housing 10. Thus, as the ballast 15 rotates the inner housing 10, the gripping mechanism, which grips consumable material such as graphite, rotates the consumable material. In this manner, the angle and direction of the tip of the consumable material extending out from tip 32 is always the same with respect to the writing surface (when the writing surface is at a consistent orientation). This is in contrast to prior art mechanical pencils and the like, where the angle stays the same relative to the outer housing of the pencil, and not the paper. As such, in embodiments of the disclosed technology, the gripping mechanism 18 rotates with the ballast and, moving around the circumference of the writing utensil, one point on the gripping mechanism and inner housing always points up (on a side opposite the ballast) and one side always points down (on a side/point of the grip/inner housing aligned with the ballast). The gripping mechanism may be any such mechanism known in the art which holds the consumable material steady, without allowing rotation thereof, within a chamber of a non-consumable writing instrument.

Still referring to FIGS. 5A and 5*b*, now moving from the bottom to the top, at the bottom of the figures is a tip 32 adapted for the point of an elongated consumable material to exit through, to be rubbed on a piece of paper or other surface for the purpose of writing. As the writing proceeds, as is known in the art, generally, a person writes by holding a writing instrument at an angle. Such writing wears away the consumable material in an uneven manner. While in the prior art there are devices which rotate graphite a little while writing, to ensure even wearing of the graphite, in embodiments of the disclosed technology, something akin to the opposite occurs. There is rotation, but the rotation is not due to writing (a detent 52 used in embodiments of the disclosed technology actually prevents rotation during writing), but rather, the rotation is a non-rotation where the graphite, or other material known in the art, remains in the same orientation while the outer housing 20 is rotated around it.

The conic piece 30 adapts the size from that of the outer/inner housing 10/20 and lower support bearing 42. The conic piece may be fixed to the inner housing 10 or outer housing 20, because, in some embodiments it may be preferable to have the conic portion rotate with the graphite, and have the back end 34, such as an eraser, also make such a rotation for added effect. In other embodiments, the conic piece 30 is fixedly attached to the outer housing 20, so that it does not rotate as the consumable material with gripping mechanism 18 rotates.

Figure 6:
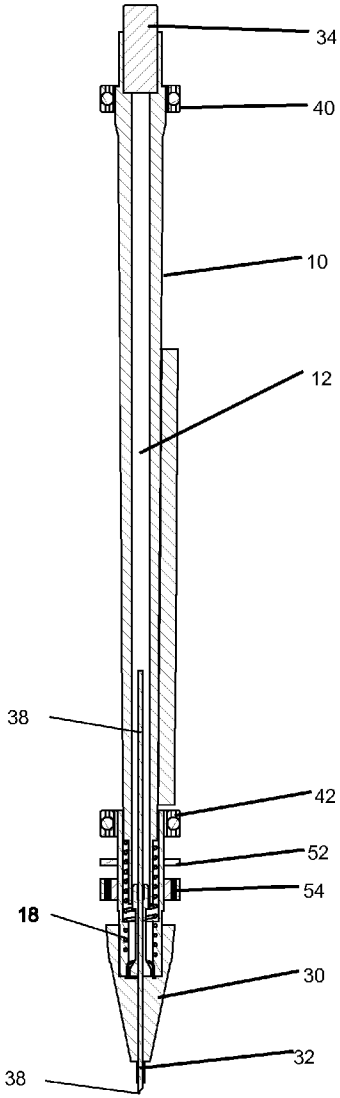
FIG. 6 shows a version of FIG. 5A with graphite therein.

FIG. 6 shows a version of FIG. 5A with graphite therein. That is, graphite 38, a consumable product, extends out the tip 32, through the gripping mechanism 18, and into the elongated hollow chamber 12. The graphite 38 is advanced by the gripping mechanism 18 to push it forward, incrementally, from the hollow chamber 12 out the tip 32. As one writes with the mechanical pencil, the tip begins to wear down. An angled tip is shown, with the flat, angled portion on the right side of the tip being the consumed side which rubs onto paper. The ballast ensures that this side of the graphite 38 remains facing towards a direction of gravity, such that when a writer holds the pencil to write on a surface, this described surface of the graphite 38 continues to be the consumed side. If the pencil outer housing 20 is oriented differently, the ballast 15 ensures the graphite 38 will return to this orientation relative to a horizontal writing surface.

It should be clear that the rotation of the consumable material and inner housing 10 is relative to the rotation of the outer housing 20. That is, one rotates while the other does not. Relative to the ground, when the writing instrument is held at an acute angle to the ground, as a user rotates the outer housing, the gripping mechanism actually does not rotate. However, this may also be described as when a user picks up the writing instrument and holds the elongated portion in a different direction relative to the ground (or paper on which writing is taking place) than it was previously in, then the gripping mechanism turns to 'return' to an orientation relative to the ground that it was originally in.

Figure 7:
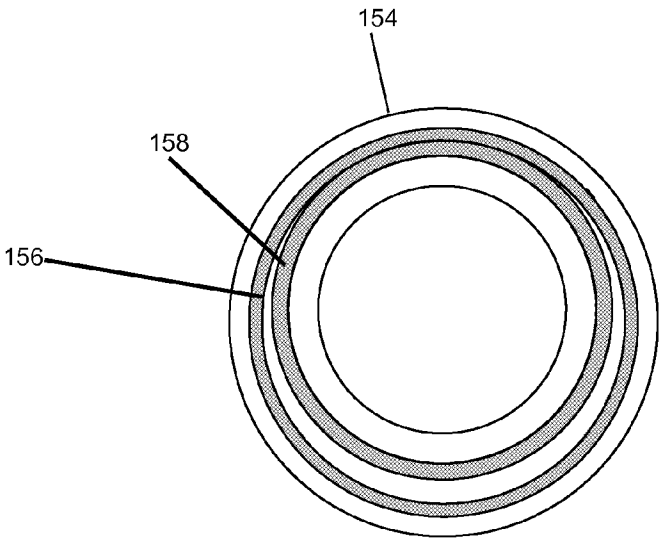
FIG. 7 shows a plan view of a frictional detent mechanism of embodiments of the disclosed technology.

FIG. 7 shows a plan view of a frictional detent mechanism of embodiments of the disclosed technology. Elements of the toothed detent mechanism 54 have been incremented by 100 and the description (above) of the toothed detent mechanism and it's elements is applicable to the frictional detent mechanism, except that the frictional detent mechanism 154 lacks teeth and functions when the outer ring 156 is frictionally engaged (touches) the inner ring 158.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A non-consumable writing implement adapted for use with a consumable product, comprising:

a body with an outer housing;

an inner retainer with gripping mechanism adapted to grip the consumable product, said inner retainer held within said outer housing;

a ballast attached to said inner retainer and rotatable with respect to said outer housing;

wherein said ballast rotates said gripping mechanism for enabling rotation of the consumable product.

2. The implement of claim 1, further comprising a frictional detent mechanism which prevents rotation of said ballast when said outer housing is bent; and writing causes said outer housing to be bent enough to engage said frictional detent mechanism.

3. The implement of claim 2, wherein said frictional detent mechanism comprises a toothed detent mechanism whereby a plurality of teeth engage when said outer housing is bent more than 50 thousandths of an inch.

4. The implement of claim 1, wherein said ballast has a greater density than said inner retainer and extends along the majority of said inner retainer.

5. The implement of claim 4, wherein:

said inner retainer extends longitudinally between a tip portion of said writing implement and an end portion opposite said tip portion, said tip adapted for writing; and said ballast extends longitudinally parallel to said inner retainer and is fixed to an outside of said inner retainer.

6. The implement of claim 5, wherein said ballast is denser and heavier than said inner retainer.

7. The implement of claim 6, further comprising a rotational damper engaged with said inner housing.

8. A writing implement comprising:

a holder adapted to frictionally hold a graphite rod within a rotatable chamber, said rotating chamber connected to a support bearing;

a weight fixedly attached to said rotatable chamber;

an outer housing connected to said support bearing; wherein a hollow space is formed between said rotatable chamber and said outer housing adapted for 360 degrees of rotation of said weight within said hollow space wherein a change in angle of said writing implement with respect to the direction of gravity causes said weight and said rotatable chamber to rotate.

9. The writing implement of claim 8, wherein a rotational damper is frictionally engaged with said rotatable chamber to prevent harmonic motion.

10. The writing implement of claim 9, further comprising a frictional detent mechanism which prevents rotation during writing.

11. The writing implement of claim 8, wherein teeth are fixedly attached to said rotatable chamber, and corresponding teeth are fixedly attached to said outer housing in such a manner as to prevent rotating of said rotatable chamber when said outer housing is bent.

12. A cylindrical writing instrument comprising:

an inner, cylindrical chamber adapted to house graphite and having a heavy and a light side;

a rotatable connection between said inner, cylindrical chamber and at least two spaced-apart support bearings;

a clamp fixedly connected to said inner, cylindrical chamber and adapted to grasp the graphite;

wherein said heavy side of said inner, cylindrical chamber rotates towards a gravitational bottom for causing the graphite therein to be rotated accordingly.

13. The writing instrument of claim 12, further comprising an outer housing with a fixed orientation to said support bearings.

14. The writing instrument of claim 13, wherein when writing at a first angle, graphite held by said clamp has an identical rotational orientation to a writing surface, regardless of a rotational orientation of said support bearings and said outer housing.

15. The writing instrument of claim 14, wherein said heavy side comprises a weight fixedly attached to said inner, cylindrical chamber.

16. The writing instrument of claim 15, wherein said weight is semi-cylindrical and runs at least a part of a length of said inner, cylindrical chamber.

17. The writing instrument of claim 13, further comprising a conic tip fixed to said outer housing.

18. The writing instrument of claim 12, further comprising a conic tip which rotates with graphite held by said clamp.

19. The writing instrument of claim 12, further comprising a locking mechanism, preventing rotating of said inner, cylindrical chamber when pressure is applied to a tip of graphite used therein.

* * * * *